US010399733B2

(12) United States Patent
Grigsby

(10) Patent No.: US 10,399,733 B2
(45) Date of Patent: Sep. 3, 2019

(54) BULK MATERIALS CONTAINER AND METHOD

(71) Applicant: Universal Forest Products, Inc., Grand Rapids, MI (US)

(72) Inventor: Charles F. Grigsby, Woodstock, GA (US)

(73) Assignee: Universal Forest Products, Inc., Grand Rapids, MI (US)

( * ) Notice: Subject to any disclaimer, the term of this patent is extended or adjusted under 35 U.S.C. 154(b) by 0 days.

(21) Appl. No.: 15/790,451

(22) Filed: Oct. 23, 2017

(65) Prior Publication Data

US 2019/0118994 A1 Apr. 25, 2019

(51) Int. Cl.

| | |
|---|---|
| ***B65D 5/02*** | (2006.01) |
| ***B65D 5/42*** | (2006.01) |
| ***B65D 5/44*** | (2006.01) |
| ***B65D 5/56*** | (2006.01) |

(52) U.S. Cl.

CPC ..... *B65D 5/0281* (2013.01); *B65D 5/4266* (2013.01); *B65D 5/443* (2013.01); *B65D 5/56* (2013.01)

(58) Field of Classification Search

CPC .... B65D 5/0281; B65D 5/4266; B65D 5/443; B65D 5/56; B65D 5/566; B65D 2519/00273; B65D 2519/00323; B65D 5/446; B65D 5/445; B65D 2519/00527

USPC ..... 229/122.32, 199.1, 122.33, 199, 918; 220/666; 206/594; 108/51.3, 56.3

See application file for complete search history.

(56) References Cited

U.S. PATENT DOCUMENTS

| | | | | | |
|---|---|---|---|---|---|
| 1,497,713 | A * | 6/1924 | Crowell | B65D 5/4266 | 229/122.21 |
| 3,119,542 | A * | 1/1964 | Pomerantz | B65D 5/5045 | 206/585 |
| 3,708,861 | A * | 1/1973 | Hickey | B65D 19/20 | 206/340 |
| 3,880,341 | A * | 4/1975 | Bamburg | B65D 5/566 | 229/122.32 |
| 3,910,482 | A * | 10/1975 | Bamburg | B65D 5/566 | 229/122.32 |
| 4,133,474 | A * | 1/1979 | Hall | B65D 5/326 | 229/122.33 |
| 4,166,569 | A * | 9/1979 | Begnaud | B65D 5/446 | 206/386 |
| 4,171,741 | A * | 10/1979 | Fish | B65D 85/68 | 206/335 |
| 4,177,935 | A * | 12/1979 | Centanni | B65D 5/566 | 229/122.32 |
| 4,586,627 | A | 5/1986 | Grigsby | | |
| 4,635,815 | A | 1/1987 | Grigsby | | |
| 5,622,306 | A | 4/1997 | Grigsby, Sr. | | |
| 6,126,067 | A | 10/2000 | Grigsby, Jr. | | |
| 6,578,758 | B1 | 6/2003 | Grigsby, Jr. | | |
| 6,808,106 | B1 | 10/2004 | Grigsby | | |

(Continued)

*Primary Examiner* — Christopher R Demeree

(74) *Attorney, Agent, or Firm* — McGarry Bair PC

(57) ABSTRACT

A first and second blank of corrugated paperboard scored to define wall panels that receive a reinforced wall panel assembly having a central pad with opposing vertical members and opposing horizontal members and a pair of U-shaped channels each attached in overlying relation with the pad, the vertical members and a respective horizontal member to secure the wall panel assembly together. A method of making a bulk materials container is disclosed.

21 Claims, 2 Drawing Sheets

(56) References Cited

U.S. PATENT DOCUMENTS

| | | | | |
|---|---|---|---|---|
| 7,229,003 | B2 | 6/2007 | Grigsby, Jr. | |
| 7,784,674 | B2 | 8/2010 | Grigsby | |
| 2009/0045248 | A1* | 2/2009 | Grigsby ..... | B65D 5/0227<br>229/185 |

* cited by examiner

BULK MATERIALS CONTAINER AND METHOD

TECHNICAL FIELD

The present invention relates to containers for holding and storing bulk materials. More particularly, the present invention relates to bulk material containers that more readily assemble and provide improved top-load compressive strength.

BACKGROUND OF THE INVENTION

Large-volume containers are often used for holding, storing, and transporting bulk materials, such as powders, agriculture leaf and root crop products, metal castings, plastic resins, particulates, granular products, and many other materials. Generally, the containers provide sturdy walls that retain the bulk materials within the container and protect the bulk materials from entry of pests and contaminants while allowing the containers to be handled by equipment such as fork lift trucks and platen or clamp trucks during use or storage in warehouses and product manufacturing facilities and during transit. The containers are also often stacked multiple units high in storage and in truck trailers during transit.

One type of container useful for holding bulk materials assembles from elongated corrugated paperboard blanks. The blanks include spaced-apart scores for folding the blank to form separate panel of the container wall. A first blank defines the exterior surface of the container wall and a second blank defines the interior surface of the container wall. A plurality of rigid members attach around a perimeter of the panels of the first blank to provide vertical and horizontal supports and the two blanks laminate together. The laminated blanks fold on the scores and attach at opposing ends to define a tubular walled body having a cavity for holding the bulk materials. The exterior blank includes flaps that fold to form a bottom and may include flaps on an opposing edge to form a top.

Bulk leaf products typically are filled through tubes that enter the container and withdraw as the container fills. A ram forces the leaf products into a block having high density and under compression within the container. The leaf products contain moisture, and the block starts expanding as the ram withdraws. A top, such as top flaps on the container that fold relative to the wall, close the container. A plurality of spaced-apart straps tighten around the container and resist the top and bottom from opening by expansion of the contents of the container. The filled containers are placed in stacks in warehouses for the leaf products to dry. After a period of time, the leaf product is removed for processing. The container is typically re-used up to five or more times depending on the quality or condition of the container after use.

While these corrugated containers have long met a need in the container industry for storage and shipping of bulk materials, opportunities for changes and improvements have become apparent. The containers have wall panels that are about four feet in length (typically 45 inch panel lengths), and this necessarily requires elongated corrugated blanks of 180 inch length for folding to form the four wall panels of the container. Two production lines are used in the manufacture and assembly of the containers. In one line, blanks move on a plurality of rollers through a glue station and onto a plurality of rollers in an assembly station. A multi-person crew attach the rigid members to the adhesive on the exterior blank. Both cold adhesive and hot melt adhesive are used to secure the rigid members to the blank. Overglue that extends outwardly of the edges of the rigid members involves waste. The overglue may further stick to the rollers and drive belts of the manufacturing equipment. The glue and adhesives may then transfer as spots of glue and adhesive onto the blanks. Glue or adhesive spots on the surface wall of the interior blank that faces the bulk materials during use may result in rejection of containers as unsatisfactory for use. The elongated exterior blank with the attached wood members is heavy and awkward for picking up and turning over to position on the interior blank that moves on a second line through a glue station and an assembly station, and subsequent laminating of the exterior and interior blanks together. Because containers in use are often stacked, the containers must have sufficient top load compressive strength to support multiple units in a stack to prevent collapse of the lower containers. Further, notwithstanding the straps that attach after filling a container with a bulk material, contents expansion presses forcingly against the walls and such may result in buckling or bulging of the closure flaps. The bulging flaps have the potential for causing a stack of containers to tip, and a container that falls or a stack that tips over can cause injury to persons as well as loss of the product if the container bursts open because of the fall.

Accordingly, there is a need in the art for a bulk materials container that provides manufacturing and top load compressive strength improvements. It is to such that the present invention is directed.

BRIEF SUMMARY OF THE INVENTION

The present invention meets the need in the art by providing a bulk materials container, comprising a first wall-forming blank of corrugated paperboard scored to provide a plurality of first main panels foldably joined together, each first main panel having a closure flap foldably joined to a first edge thereof. A respective one of a plurality of reinforcement panel assemblies adhesively attaches to a respective main panel of the first wall-forming blank of corrugated paperboard. Each of the reinforcement panel assemblies comprises a pad having opposing planar sides with opposing first side edges and opposing second side edges. A pair of first support members are each disposed adjacent a respective one of the opposing first side edges of the pad. A pair of second support members are each disposed adjacent a respective one of the opposing second side edges of the pad. A pair of liner sheets are each folded to define a U-shaped channel having opposing interior surfaces. The opposing interior surfaces each attach to a respective one of the opposing planar sides of the reinforcement panel assembly in overlying relation to the pad, the first support members, and the second support member on a respective one of the second side edges of the pad. The liner sheet extends a length substantially between respective outer edges of the first support members and extends to a distal edge remote from an edge of the respective second support member, for securing the pair of first support members and the respective one of the second support members to the pad. A second wall-forming blank of corrugated paperboard scored to provide a plurality of second main panels foldably joined together, each second main panel having a closure flap foldably joined to an edge portion thereof, the second wall forming blank laminated in overlying relation with a respective second main panel attached to a respective one of the reinforcement panel assemblies. The wall-forming blanks, being folded on the respective scores, forms the side walls of the bulk materials container and the respective closure flaps, being folded on the respective scores, close an end opening thereof.

In another aspect, the present invention provides a method of manufacturing a bulk materials container, comprising the steps of:

(a) making a plurality of reinforcement panel assemblies, comprising the steps of:

i) disposing a pair of first support members adjacent a respective one of a pair of opposing first side edges of a pad having opposing planar surfaces;

ii) disposing a pair of second support members adjacent a respective one of a pair of opposing second side edges of the pad;

iii) securing the first support members and a respective one of the second support members with a respective one of a pair of U-shaped channels that each attaches in overlying relation to the pad, the first support members and a respective one of the second support members on a respective one of the second side edges of the pad, the U-shaped channel extending a length substantially between respective outer edges of the first support members and extending to a distal width edge remote from and overlapping an edge of the respective second support member, for securing the pair of first support members and the respective one of the second support members to the pad;

(b) scoring a first wall-forming blank of corrugated paperboard to define a plurality of first main panels foldably joined together;

(c) attaching one of the reinforcement panel assemblies to a respective main panel of the first wall-forming blank of corrugated paperboard;

(d) scoring a second wall-forming blank of corrugated paperboard to define a plurality of second main panels foldably joined together; and (e) attaching a respective second main panel to a respective one of the reinforcement panel assemblies, whereby the first and second wall-forming blanks, being folded on the respective scores, forms side walls of the bulk materials container.

Objects, advantages and features of the present invention will become apparent from a reading of the following detailed description of the invention and claims in view of the appended drawings.

DETAILED DESCRIPTION

Figure 1:
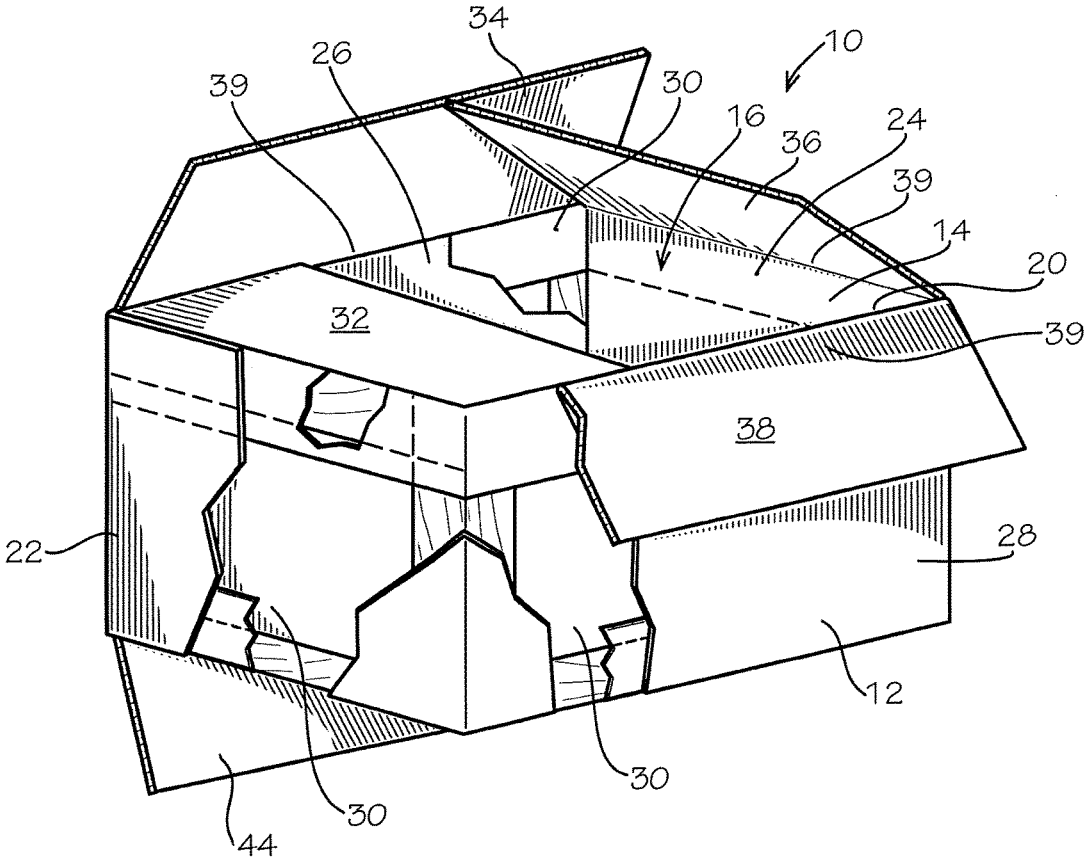
FIG. 1 illustrates in perspective view a bulk materials container according to the present invention, with portions cut away to illustrate features of the container.

Referring now in more detail to the drawings, in which like numerals indicate like parts throughout the several views, FIG. 1 illustrates in perspective partially cut-away view a container 10 of the present invention for holding bulk materials. The container 10 comprises a tubular body having an outer wall generally 12 and inner wall generally 14 that define an interior cavity 16 for holding bulk materials or other goods. The outer wall 12 and the inner wall 14 are each made from elongated blanks of a sheet material such as corrugated paperboard made conventionally with at least a flute sheet and a linerboard also known as paperboard or fibreboard. Without limitation, the blanks may be single wall, double wall, triple wall, or variations, of conventional corrugated paperboard. The blanks laminate together and fold on scores (discussed below) to define opposing end panels 22, 24 and opposing side panels 26, 28. The blanks laminate together to sandwich a reinforcement panel assembly 30 between the outer wall 12 and the inner wall 14 of each wall or main panel 22, 24, 26, and 28.

With continuing reference to FIG. 1, the container 10 includes top flaps 32, 34, 36, and 38 that foldingly close along a score 39 at an upper edge of the container to define a closable cover for the container. Opposing bottom flaps 42, 44, 46, and 48 (see FIG. 2) foldingly close along a score 49 at a bottom edge to define a closed bottom of the container.

In an alternate embodiment, respective edges of the blanks are closed by an overlapped tab to seal the flutes of the corrugated paperboard blank. The tab may be a separate sheet or may be defined by a laterally extending portion of the liner sheet of the corrugated paperboard. The portion of the liner sheet extends laterally of a terminating distal edge of the flute sheet. The tab overlaps the distal edge and attaches with an adhesive to an opposing surface. The tab thereby closes or seals the open channels at the edge of the corrugated flute sheet from infiltration of particulates.

Figure 2:
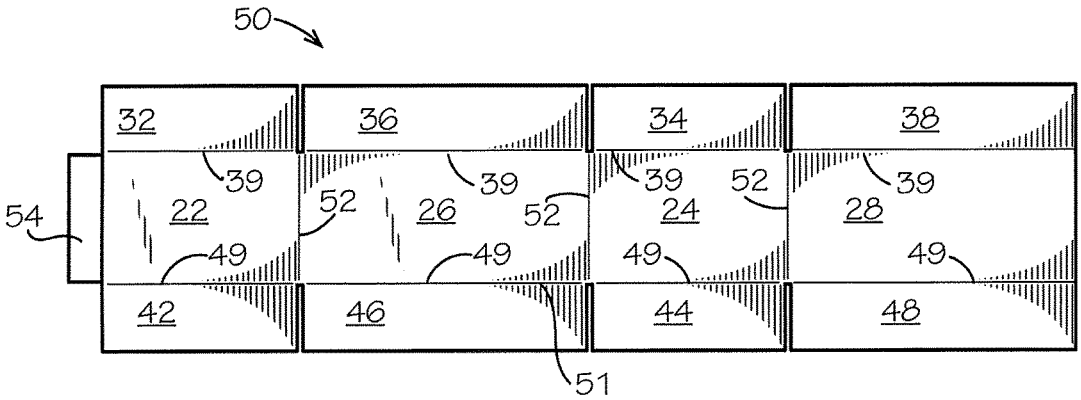
FIG. 2 illustrates in a plan view a corrugated paperboard blank for forming the container shown in FIG. 1.

FIG. 2 illustrates in plan view a corrugated paperboard blank 50 for forming the outer or exterior wall 12 of the container 10. The blank 50 includes at least a flute member and a liner sheet, but typically the blank sandwiches the flute member with opposing liner sheets. Double wall or triple wall corrugated paperboard can be used as well. The illustrated embodiment uses BC flute corrugated paperboard. The blank 50 includes the two opposing end panels 22, 24 and the two opposing side panels 26, 28 with the panels foldably connected along respective scores 52. The end panels 22, 24 and the side panels 26, 28 define the exterior sides of the container 10 shown in FIG. 1. A manufacturer's joint flap 54 foldably connects on a score to the end panel 22. The manufacturer's joint flap 54 attaches with adhesive to a side portion of the side panel 28 to form a tubular body for the container 10. The scores 52 also facilitate the container 10 to substantially flatten to a knock-down position for shipping from a container manufacturer to a company using the container. For use, the container 10 is squared-open as in FIG. 1 to define the cavity 16 for holding bulk materials.

FIG. 2 further illustrates the series of top flaps 32, 34, 36 and 38 and the opposing four bottom flaps 42, 44, 46, and 48. The respective top and bottom flaps foldably attach to the end and side panels 22, 24, 26, and 28, along the respective scores 39, 49. The flaps may be of a single common width that would be, at a minimum, of about slightly less than one half the width of the container, and at a maximum, approximately equal to the width of the container. An alternate embodiment (not illustrated) uses a detachable cap for a closing cover without top flap structure.

In an alternate embodiment, a wear member 51 may be disposed along the score lines 49 and overlap portions of the main panels 22, 24, 26, and 28 and the flaps 42, 44, 46, and 48. The wear member 51 resists wear that may arise from contact of the container 10 with rough surfaces such as warehouse floors, as the container 10 is moved and handled in warehouses or in trailers. The wear member is an elongate member, such as a polyethylene tape, a fiber-reinforced tape, a plate such as metal or plastic, and may be attached adhesively to the blank or received inwardly of the blank during its construction and assembly.

The interior wall 14 of the container 10 is formed of an elongated corrugated paperboard blank similar to the blank 50 but without the manufacture's joint flap. In the illustrated embodiment, the blank for the inner wall 14 includes a flute member and a liner sheet. As with the blank for the outer wall, the blank for the inner wall can be single, double or triple wall corrugated paperboard. The illustrated embodiment uses C flute corrugated paperboard. Alternatively, the blank for the interior wall 14 may not include the opposing top flaps and bottom flaps.

Figure 3:
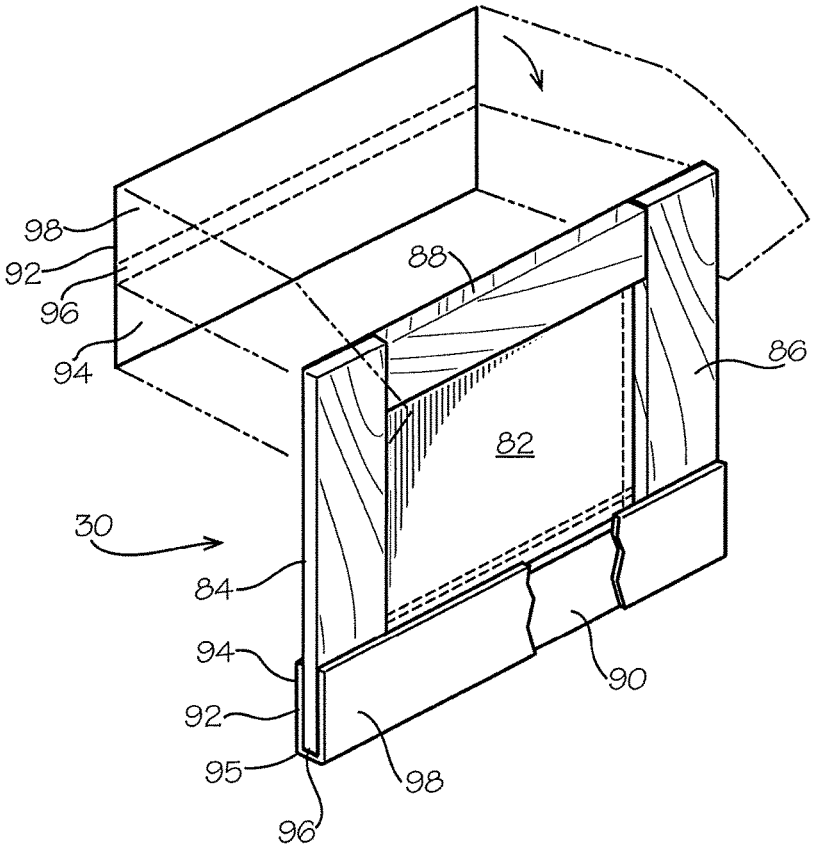
FIG. 3 illustrates in exploded perspective view a wall panel assembly that attaches to a wall panel of the corrugated paperboard blank for the container shown in FIG. 1.

FIG. 3 illustrates in exploded perspective view the wall panel assembly 30 that attaches to a panel of the corrugated paperboard blank for the container 10 shown in FIG. 1. The wall panel assembly 30 includes a central planar pad 82. A pair of side members 84, 86 seat against first opposing side edges of the pad 82. The side members 84, 86 have a length that is substantially the height of the container 10. A pair of horizontal members 88, 90 seat against the second opposing edges (in the illustrated embodiment, the top and bottom edges) of the planar pad 82. Opposing distal ends of the horizontal members 88, 90 contact the respective inner edge of the vertical members 84, 86. A pair of stiffeners 92 attach adhesively in overlying relation to the vertical members 84, 86, to a respective horizontal member 88, 90, and to edge portions of the central pad 82, and on opposing sides. The stiffeners 92 are elongated liner sheets. The stiffener 92 folds into a U-shaped channel 95 having a first side portion 94, a transition 96, and a second side portion 98. Scores in the fibreboard sheet may facilitate folding to form the U-shape channel.

The first and second side portions 94, 98 overlie and attach with an adhesive in securing relation to a respective opposing first and second side of the assembly 30 to hold the members 84, 86 and 88, 90 secured to the pad 82. This is accomplished by attaching the first side portion 94 of the liner sheet 92 with adhesive to the vertical members 84, 86, to the horizontal member 88, and to adjacent portions of the pad 82. The liner sheet 92 folds over to dispose the transition 96 on the end edges of the vertical members 84, 86 and the outward edge of the horizontal member 88. The second side portion 98 then similarly attaches adhesively to the opposing side of the vertical members 84, 86, to the horizontal member 88, and to adjacent portions of the central pad 82, on the opposing side of the wall panel assembly 30.

A second one of the stiffeners 92 similarly attaches in opposing relation to the first stiffener (i.e., at a bottom portion of the wall panel assembly 30 opposing the first stiffener at an upper portion of the wall panel assembly). The first portion 94 of the second stiffener 92 attaches with adhesive to a first side and the second portion 98 attaches to an opposing side. The stiffener 92 attaches to the opposing surfaces of the vertical members 84, 86, to the horizontal member 90, and to adjacent portions of the pad 82 in overlying relation. The stiffener 92 thereby adhesively secures the vertical members 84, 86, the horizontal member 88, and the respective adjacent portions of the central pad 82 together in the wall panel assembly 30.

The unitary stiffener 92 adhesively interlocks and secures the vertical members 84, 86, the horizontal members 88, 90 and the pad 82 together. The panel assemblies 30 are manufactured on a separate line and stacked as work-in-progress for assembly of the container 10.

The vertical and horizontal members 84, 86 and 88, 90 can be formed of any suitably rigid material, such as a hardwood or similar structural member, typically ranging in thickness from ⅛ inch to ½ inch and in width from 3 to 6 inches, but may be narrower or wider as may be determined appropriate based an analysis of the particular loading application. The length of the members 84, 86 is based on the height of the container 10.

While FIG. 1 does not illustrate a bottom support member such as a pallet or a slip sheet, various bottom support members could be provided including, but not limited to, pallets, slip sheets and bottom caps. Such bottom support members are well known in the art, and are not disclosed further herein.

The container 10 assembles by first passing the blank 50 over a glue applicator roller, adhesive sprayer or other device for placing adhesive on the planar surface. A respective one of the wall panel reinforcement assemblies 30, manufactured as a separate assembly, are placed on the adhesive on each of the end and side panels 22, 24, 26 and 28. The blank for the inner wall 14 similarly passes over a glue applicator, and the adhesive coated blank then is placed in overlying relation onto the reinforcement assembly 30 with the panels of the blank aligned for folding on the scores. A laminator roller fixes the inner wall 14, the reinforcement pads 30 and the outer wall 12. The laminated inner and outer wall connect with the manufacturer's joint 54 to form the tubular container.

Prior to use, the knocked-down container 10 is squared-open to define the cavity 16 for receiving bulk materials. The bottom flaps 42, 44, 46, and 48 are folded on the respective scores towards the respective opposing flap, and optionally secured such as with tape or adhesive, to close the open lower end of the container 10. Upon filling, the top flaps 32, 34, 36 and 38 fold on the respective scores towards the respective opposing flap to close the open upper end of the container 10. A plurality of straps wrap around the container to hold the flaps closed.

The reinforced panel assemblies 30 laminated between the exterior wall 12 and the interior wall 14 provide strong side walls for containing bulk materials and improved top loading compression strength to the bulk materials container 10 to resist bulging and buckling arising from the bulk materials products held in the container. The present invention provides an improved bulk materials container suitable for holding agriculture and leaf products, granular materials, bulk particulate materials, or other bulk items requiring long-term storage while restricting lodging and infiltration of particulates in the channels of the corrugated paperboard sheets that form the inner wall and the outer wall. The present invention furthermore provides a one-piece, integral unit that can be knocked down flat for shipment to an end user and easily and quickly set up by an end user.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A bulk materials container, comprising:

a first wall-forming blank of corrugated paperboard scored to provide a plurality of first main panels foldably joined together, each of the plurality of first main panels defining a side wall and having a first closure flap foldably joined to a first edge thereof;

a plurality of reinforcement panel assemblies, each of the plurality of reinforcement panel assemblies mounted to a respective side wall of the first main panel of the first wall-forming blank of corrugated paperboard, each of the plurality of reinforcement panel assemblies comprising:

a pad having opposing planar sides with opposing first side edges and opposing second side edges;

a pair of first support members each disposed adjacent a respective one of the opposing first side edges of the pad;

a pair of second support members each disposed adjacent a respective one of the opposing second side edges of the pad; and a pair of liner sheets, each of the pair of liner sheets folded to define a U-shaped channel having opposing interior surfaces that attach to a respective one of the opposing planar sides of the pad in overlying relation to the pad, the pair of first support members, and a respective one of the pair of second support members on the respective one of the opposing second side edges of the pad, each of the pair of liner sheets extending a length substantially between respective outer edges of the pair of first support members and extending to a distal edge remote from an edge of the respective one of the pair of second support members, configured to secure the pair of first support members and the respective one of the pair of second support members to the pad; and a second wall-forming blank of corrugated paperboard scored to provide a plurality of second main panels foldably joined together, each of the plurality of second main panels having a second closure flap foldably joined to an edge portion thereof, the second wall-forming blank laminated in overlying relation with a respective one of the plurality of second main panels attached to a respective one of the plurality of reinforcement panel assemblies, whereby the first wall-forming blank and the second wall-forming blank, being folded on the respective scores, forms the side walls of the bulk materials container and the respective one of the first closure flap and the second closure flap, being folded on the respective scores, close an end opening thereof.

2. The bulk materials container as recited in claim 1, wherein the first wall-forming blank of corrugated paperboard further comprises at least a flute member sandwiched between opposing liner sheets.

3. The bulk materials container as recited in claim 1, wherein at least one of the first main panels of the first wall-forming blank of corrugated paperboard further comprises a third closure flap foldably joined to a second edge of the first main panel opposing the first edge.

4. The bulk materials container as recited in claim 1, wherein the second wall-forming blank of corrugated paperboard comprises at least a flute member attached to a liner sheet.

5. The bulk materials container as recited in claim 1, wherein at least one of the second main panels of the second wall-forming blank of corrugated paperboard further comprises a fourth closure flap foldably joined to a second edge of the second main panel opposing the first edge.

6. The bulk material container as recited in claim 1, wherein the pad comprises a corrugated paperboard sheet.

7. The bulk material container as recited in claim 1, wherein the pad comprises fibreboard.

8. The bulk materials container as recited in claim 1, wherein the opposing interior surfaces of each of the pair of liner sheets attach adhesively to the pad, the pair of first support members and the pair of second support members.

9. A bulk materials container, comprising:

a first wall-forming blank of corrugated paperboard scored to provide a plurality of first main panels foldably joined together, each of the plurality of first main panels defining a side wall and having a first closure flap foldably joined to a first edge of the side wall and a second closure flap foldably joined to a second edge of the side wall wherein the second edge opposes the first edge;

a plurality of reinforcement panel assemblies, each of the plurality of reinforcement panel assemblies mounted to a respective one of the side walls of the first main panel of the first wall-forming blank of corrugated paperboard, each of the plurality of reinforcement panel assemblies, comprising:

a pad having opposing planar sides with opposing first side edges and opposing second side edges;

a pair of first support members each disposed adjacent a respective one of the opposing first side edges of the pad;

a pair of second support members each disposed adjacent a respective one of the opposing second side edges of the pad; and a pair of liner sheets, each of the pair of liner sheets folded to define a U-shaped channel that attaches in overlying relation to the pad, the first support members and a respective one of the second support members on a respective one of the second side edges of the pad, each of the pair of liner sheets extending a length substantially between respective outer edges of the pair of first support members and extending to a distal width edge distal from the second side edge and overlying an edge of the respective one of the pair of second support members adjacent the respective second side edge of the pad, configure to secure the pair of first support members and the respective one of the pair of second support members to the pad; and a second wall-forming blank of corrugated paperboard scored to provide a plurality of second main panels foldably joined together, each of the plurality of second main panels having a third closure flap foldably joined to a first edge and a fourth closure flap foldably joined to a second edge opposing the first edge, the second wall forming blank laminated in overlying relation with a respective one of the plurality of second main panels attached to a respective one of the plurality of reinforcement panel assemblies, whereby the first wall-forming blank and the second wall forming blank, being folded on the respective scores, forms side walls of the bulk materials container and the respective first and second closure flaps, being folded on the respective scores, close a respective end opening thereof.

10. The bulk materials container as recited in claim 9, wherein the first wall-forming blank of corrugated paperboard further comprises at least a flute member sandwiched between opposing liner sheets.

11. The bulk materials container as recited in claim 10, wherein the second wall-forming blank of corrugated paperboard comprises at least a flute member attached to a liner sheet.

12. The bulk material container as recited in claim 11, wherein the pad comprises a corrugated paperboard sheet.

13. The bulk materials container as recited in claim 9, wherein the second wall-forming blank of corrugated paperboard comprises at least a flute member attached to a liner sheet.

14. The bulk material container as recited in claim 9, wherein the pad comprises a corrugated paperboard sheet.

15. The bulk material container as recited in claim 9, wherein the pad comprises fibreboard.

16. The bulk materials container as recited in claim 9, wherein the opposing interior surfaces of each of the pair of liner sheets attach adhesively to the pad, the pair of first support members and the pair of second support members.

17. A method of manufacturing a bulk materials container as called for in claim 1, comprising the steps of:

(a) making a plurality of reinforcement panel assemblies, comprising the steps of:

i) disposing a pair of first support members adjacent a respective one of a pair of opposing first side edges of a pad having opposing planar surfaces;

ii) disposing a pair of second support members adjacent a respective one of a pair of opposing second side edges of the pad;

iii) securing the pair of first support members and a respective one of the pair of second support members with a respective one of a pair of U-shaped channels that each attaches in overlying relation to the pad, the pair of first support members and a respective one of the pair of second support members on a respective one of the opposing second side edges of the pad, the U-shaped channel extending a length substantially between respective outer edges of the pair of first support members and extending to a distal width edge remote from and overlapping an edge of the respective one of the pair of second support member, for securing the pair of first support members and the respective one of the pair of second support members to the pad;

(b) scoring a first wall-forming blank of corrugated paperboard to define a plurality of first main panels foldably joined together;

(c) attaching one of the plurality of reinforcement panel assemblies to a respective first main panel of the first wall-forming blank of corrugated paperboard;

(d) scoring a second wall-forming blank of corrugated paperboard to define a plurality of second main panels foldably joined together; and (e) attaching a respective one of the plurality of second main panel to a respective one of the plurality of reinforcement panel assemblies, whereby the first and second wall-forming blanks, being folded on the respective scores, forms side walls of the bulk materials container.

18. The method as recited in claim 17, further comprising the step of providing at least one of the first main panels with a first closure flap foldably joined to a first edge thereof.

19. The method as recited in claim 18, further comprising the step of providing at least one of the first main panels with a second closure flap foldably joined to a second edge thereof opposing the first edge.

20. The method as recited in claim 17, further comprising the step of providing at least one of the plurality of second main panels a third closure flap foldably joined to an edge portion thereof.

21. The method as recited in claim 20, further comprising the step of providing at least one of the plurality of second main panels with a fourth closure flap foldably joined to a second edge thereof opposing the first edge.

* * * * *